US008348648B2

(12) United States Patent
Miyamura et al.

(10) Patent No.: US 8,348,648 B2
(45) Date of Patent: Jan. 8, 2013

(54) SINGLE SCREW COMPRESSOR

(75) Inventors: Harunori Miyamura, Osaka (JP); Tadashi Okada, Osaka (JP); Takayuki Takahashi, Osaka (JP); Kaname Ohtsuka, Osaka (JP); Toshihiro Susa, Osaka (JP); Hiromichi Ueno, Osaka (JP); Takanori Murono, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 556 days.

(21) Appl. No.: 12/672,196

(22) PCT Filed: Aug. 7, 2008

(86) PCT No.: PCT/JP2008/002154
§ 371 (c)(1),
(2), (4) Date: Feb. 4, 2010

(87) PCT Pub. No.: WO2009/019880
PCT Pub. Date: Feb. 12, 2009

(65) Prior Publication Data

US 2011/0070117 A1 Mar. 24, 2011

(30) Foreign Application Priority Data

Aug. 7, 2007 (JP) ..... 2007-205775

(51) Int. Cl.

| | |
|---|---|
| ***F01C 1/08*** | (2006.01) |
| ***F01C 1/24*** | (2006.01) |
| ***F03C 2/00*** | (2006.01) |
| ***F03C 4/00*** | (2006.01) |
| ***F04C 2/00*** | (2006.01) |
| ***F04C 18/00*** | (2006.01) |
| ***F16N 13/20*** | (2006.01) |

(52) U.S. Cl. ..... 418/195; 418/194; 418/196; 418/197; 418/198

(58) Field of Classification Search ..... 418/194, 418/195, 196, 197, 198
See application file for complete search history.

(56) References Cited

U.S. PATENT DOCUMENTS 3,133,695 A * 5/1964 Zimmern ..... 418/87
3,181,296 A * 5/1965 Zimmern ..... 60/39.63
3,551,082 A * 12/1970 Bernard ..... 418/195
(Continued)

FOREIGN PATENT DOCUMENTS

JP 60-17284 A 1/1985
(Continued)

*Primary Examiner* — Kenneth Bomberg
*Assistant Examiner* — Dapinder Singh
(74) *Attorney, Agent, or Firm* — Birch, Stewart, Kolasch & Birch, LLP

(57) ABSTRACT

In a single screw compressor, gates (51) of gate rotors (50) are to be engaged with spiral grooves (41) of a screw rotor (40). In each spiral groove (41) of the screw rotor (40), an area extending from a start point of the spiral groove (41) to a position in a compression stroke is a suction-side portion (45), and the remaining portion (portion up to a terminal point of the spiral groove (41)) is a discharge-side portion (46). In the discharge-side portion (46), a clearance between a wall surface (42, 43, 44) therein and the gate (51) is substantially "0 (zero)." A clearance between the wall surface (42, 43, 44) in the suction-side portion (45) and the gate (51) is wider than that between the wall surface (42, 43, 44) in the discharge-side portion (46) and the gate (51), and is gradually narrowed from the start point toward the terminal point in the spiral groove (41).

8 Claims, 10 Drawing Sheets

U.S. PATENT DOCUMENTS

| | | | | | |
|---|---|---|---|---|---|
| 3,708,249 | A | * | 1/1973 | Luthi | 417/203 |
| 3,752,606 | A | * | 8/1973 | Zimmern | 418/97 |
| 3,874,828 | A | * | 4/1975 | Herschler et al. | 418/87 |
| 3,945,778 | A | * | 3/1976 | Zimmern | 418/195 |
| 4,028,016 | A | * | 6/1977 | Keijer | 417/440 |
| 4,179,250 | A | * | 12/1979 | Patel | 418/195 |
| 4,261,691 | A | * | 4/1981 | Zimmern et al. | 417/440 |
| 4,342,548 | A | * | 8/1982 | Zimmern | 418/195 |
| 4,364,714 | A | * | 12/1982 | Zimmern | 417/53 |
| 4,470,777 | A | * | 9/1984 | Zimmern | 418/46 |
| 4,488,858 | A | * | 12/1984 | Glanvall | 418/195 |
| 4,704,069 | A | * | 11/1987 | Kocher et al. | 417/53 |
| 4,773,837 | A | * | 9/1988 | Shimomura et al. | 418/180 |
| 4,775,304 | A | * | 10/1988 | Bein | 418/99 |
| 4,824,348 | A | * | 4/1989 | Winyard | 418/195 |
| 4,880,367 | A | * | 11/1989 | Bein | 418/107 |
| 4,890,989 | A | * | 1/1990 | Zimmern | 418/153 |
| 4,981,424 | A | * | 1/1991 | Bein | 418/99 |
| 5,082,431 | A | * | 1/1992 | Bein | 418/97 |
| 5,087,182 | A | | 2/1992 | Zimmern et al. | |
| 5,454,700 | A | | 10/1995 | Iguchi et al. | |
| 5,642,992 | A | * | 7/1997 | Shaw | 418/152 |
| 5,782,624 | A | * | 7/1998 | Jensen | 418/195 |
| 5,807,091 | A | * | 9/1998 | Shaw | 418/152 |
| 6,093,007 | A | * | 7/2000 | Shaw | 418/197 |
| 6,205,779 | B1 | * | 3/2001 | Botosan et al. | 60/330 |
| 6,217,304 | B1 | * | 4/2001 | Shaw | 418/100 |
| 6,398,532 | B1 | * | 6/2002 | Zha et al. | 418/195 |
| 6,896,501 | B2 | * | 5/2005 | Ueno et al. | 418/195 |
| 7,153,112 | B2 | * | 12/2006 | Zarnoch et al. | 418/195 |
| 7,891,955 | B2 | * | 2/2011 | Picouet | 417/213 |
| 2004/0037730 | A1 | * | 2/2004 | Ueno et al. | 418/195 |
| 2005/0123429 | A1 | * | 6/2005 | Zarnoch et al. | 418/195 |
| 2005/0152803 | A1 | * | 7/2005 | Manfredini et al. | 418/196 |
| 2006/0210419 | A1 | * | 9/2006 | Chadwick, II | 418/196 |
| 2007/0172375 | A1 | * | 7/2007 | Lurtz | 418/196 |

FOREIGN PATENT DOCUMENTS

| | | | |
|---|---|---|---|
| JP | 3-164591 | A | 7/1991 |
| JP | 6-317273 | A | 11/1994 |
| JP | 11-336681 | A | 12/1999 |
| JP | 2002-202080 | A | 7/2002 |

* cited by examiner 40
41
41
41

FIG. 13A Room Temperature State
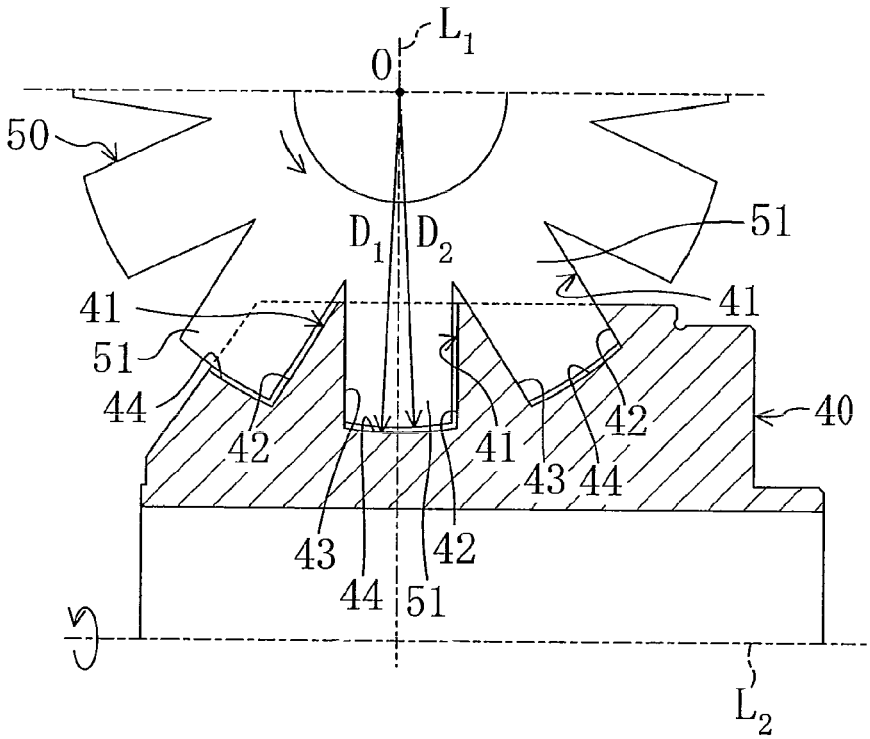
FIG. 13B Operating Temperature State
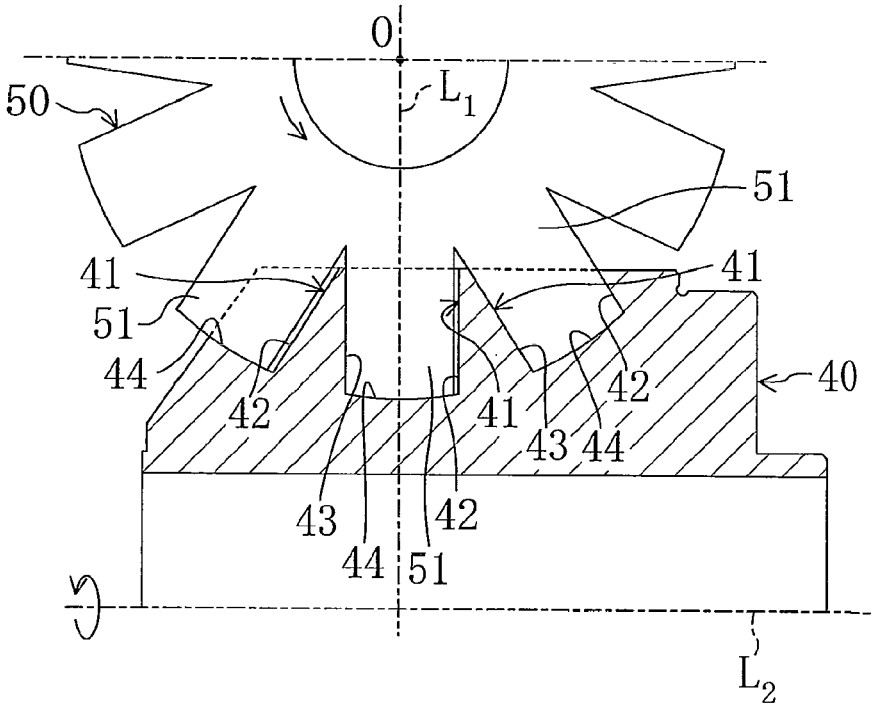

SINGLE SCREW COMPRESSOR

TECHNICAL FIELD

The present invention relates to improvement of efficiency of a single screw compressor.

BACKGROUND ART

Conventionally, single screw compressors have been used as compressors for compressing refrigerant or air. For example, Patent Document 1 discloses a single screw compressor including a single screw rotor and two gate rotors.

Such a single screw compressor will be described. The screw rotor is formed in an approximately cylindrical shape, and a plurality of spiral grooves are formed in an outer circumference thereof. The gate rotors are formed in an approximately flat plate-like shape, and are arranged on sides of the screw rotor. A plurality of rectangular plate-like gates are radially provided in the gate rotor. The gate rotor is installed with its rotation axis being perpendicular to a rotation axis of the screw rotor, and the gate is to be engaged with the spiral groove of the screw rotor.

In the single screw compressor, the screw rotor and the gate rotors are accommodated in a casing, and the spiral groove of the screw rotor, the gate of the gate rotor, and an inner wall surface of the casing define a compression chamber. When rotatably driving the screw rotor by an electric motor, etc., the gate rotors rotate in response to the rotation of the screw rotor. Subsequently, the gate of the gate rotor relatively moves from a start point (end portion on a suction side) toward a terminal point (end portion on a discharge side) in the spiral groove with which the gate is engaged, thereby gradually reducing the volume of the completely-closed compression chamber. Consequently, fluid in the compression chamber is compressed.

CITATION LIST

Patent Document

PATENT DOCUMENT 1: Japanese Patent Publication No. 2002-202080

SUMMARY OF THE INVENTION

Technical Problem

In the single screw compressor, after the compression chamber is completely closed, an internal pressure of the compression chamber gradually increases as the gate moves along the spiral groove. At this point, if hermeticity in the compression chamber is not maintained, gas such as refrigerant leaks from the compression chamber, thereby reducing a fluid discharge amount from the single screw compressor. As a method for enhancing the hermeticity in the compression chamber, a method by possibly narrowing a space between a wall surface of the spiral groove of the screw rotor and the gate of the gate rotor has been considered. However, if such a space is extremely narrowed, power consumed due to a slide of the gate in the screw rotor increases, resulting in an increase in energy such as electric power, which is required for an operation of the single screw compressor.

The present invention has been made in view of the foregoing, and it is an object of the present invention to ensure the sufficient fluid discharge amount from the single screw compressor, and to reduce the energy required for the operation thereof

Solution to the Problem

First and second aspects of the invention are intended for a single screw compressor which includes a screw rotor (40) formed with spiral grooves (41) in an outer circumference, a casing (10) in which the screw rotor (40) is accommodated, and gate rotors (50) with a plurality of radially-formed gates (51) to be engaged with the spiral grooves (41) of the screw rotor (40), and which compresses fluid in a compression chamber (23) defined by the screw rotor (40), the casing (10), and the gate (51), by relatively moving the gate (51) from a start point to a terminal point in the spiral groove (41).

In the first aspect of the invention, a discharge-side portion (46) is a portion of the spiral groove (41) from a predetermined position in a compression stroke to the terminal point, and a clearance between a wall surface in a suction-side portion (45) which is a portion of the spiral groove (41) other than the discharge-side portion (46), and the gate (51) is wider than that between a wall surface in the discharge-side portion (46) and the gate (51).

In addition, in the second aspect of the invention, a wall surface in a discharge-side portion (46) which is a portion of the spiral groove (41) from a predetermined position in a compression stroke to the terminal point contacts both side surfaces and tip end surface of the gate (51); and a clearance between a wall surface in a suction-side portion (45) which is a portion of the spiral groove (41) other than discharge-side portion (46), and the gate (51) is wider than that between the wall surface in the discharge-side portion (46) and the gate (51).

In the first and second aspects of the invention, the gate (51) of the gate rotor (50) is to be engaged with the spiral groove (41) of the screw rotor (40). When rotating the screw rotor (40) and the gate rotors (50), the gate (51) relatively moves from the start point to the terminal point in the spiral groove (41), thereby compressing the fluid in the compression chamber (23). In the spiral groove (41) of the screw rotor (40), the portion extending from the predetermined position in the compression stroke to the terminal point is the discharge-side portion (46), and the remaining portion is the suction-side portion (45). In the course of relatively moving the gate (51) from the start point toward the terminal point in the spiral groove (41), the gate (51) first moves along the wall surfaces in the suction-side portion (45), and then moves along the wall surfaces in the discharge-side portion (46). While relatively moving the gate (51) from the start point toward the terminal point in the spiral groove (41), an internal pressure in the compression chamber (23) gradually increases.

When the gate (51) reaches the discharge-side portion (46) of the spiral groove (41), the internal pressure in the compression chamber (23) is somewhat high, and a differential pressure between front and back sides of the gate (51) is relatively large. Thus, if hermeticity in the compression chamber (23) is insufficient, an amount of fluid leaking from the compression chamber (23) becomes excessive.

On the other hand, in the first aspect of the invention, the clearance between the wall surface in the discharge-side portion (46) of the spiral groove (41) and the gate (51) is narrower than that between the wall surface in the suction-side portion (45) and the gate (51). Thus, in the first aspect of the invention, the hermeticity in the compression chamber (23) is relatively high when the gate (51) is positioned in the discharge-side portion (46) of the spiral groove (41). In the second aspect of the invention, the wall surfaces in the discharge-side portion (46) of the spiral groove (41) contact the both side surfaces and tip end surface of the gate (51). Thus, in the second aspect of the invention, the sufficient hermeticity in the compression chamber (23) is maintained when the gate (51) is positioned in the discharge-side portion (46) of the spiral groove (41).

When the gate (51) is positioned in the suction-side portion (45) of the spiral groove (41), the internal pressure in the compression chamber (23) is not so high, and the differential pressure between the front and back sides of the gate (51) is relatively small. Consequently, even if the hermeticity in the compression chamber (23) is not so high, the amount of the fluid leaking from the compression chamber (23) can be reduced.

In the first and second aspects of the invention, the clearance between the wall surface in the suction-side portion (45) of the spiral groove (41) and the gate (51) is wider than that between the wall surface in the discharge-side portion (46) and the gate (51). Thus, in such aspects of the invention, sliding resistance between the wall surface in the suction-side portion (45) of the spiral groove (41) and the gate (51) is reduced, resulting in reduction in power consumed due to a slide of the gate (51) in the screw rotor (40).

A third aspect of the invention is intended for the single screw compressor of the first or second aspect of the invention, in which the clearance between the wall surface in the suction-side portion (45) of the spiral groove (41) and the gate (51) is gradually narrowed as the gate (51) moves toward the terminal point of the spiral groove (41).

In the third aspect of the invention, the hermeticity in the compression chamber (23) gradually increases as the gate (51) positioned in the suction-side portion (45) moves closer to the discharge-side portion (46). As described above, in the course of relatively moving the gate (51) from the start point toward the terminal point in the spiral groove (41), the internal pressure in the compression chamber (23) gradually increases with an increase in the hermeticity required in the compression chamber (23). In the present invention, the clearance between the wall surface in the suction-side portion (45) of the spiral groove (41) and the gate (51) is gradually changed, thereby maintaining the hermeticity required in the compression chamber (23), and reducing the sliding resistance between the screw rotor (40) and the gate rotor (50).

A fourth aspect of the invention is intended for the single screw compressor of the first or second aspect of the invention, in which a clearance between a side wall surface (42, 43) in the suction-side portion (45) of the spiral groove (41) and the side surface of the gate (51) is wider than that between a side wall surface (42, 43) in the discharge-side portion (46) of the spiral groove (41) and the side surface of the gate (51).

In the fourth aspect of the invention, the clearance between the side wall surface (42, 43) therein and the side surface of the gate (51) is ensured. This reduces the power consumed due to the slide of the side surface of the gate (51) on the side wall surface (42, 43) of the spiral groove (41).

A fifth aspect of the invention is intended for the single screw compressor of the first or second aspect of the invention, in which a clearance between a bottom wall surface (44) in the suction-side portion (45) of the spiral groove (41) and a tip end surface of the gate (51) is wider than that between a bottom wall surface (44) in the discharge-side portion (46) of the spiral groove (41) and the tip end surface of the gate (51).

In the fifth aspect of the invention, the clearance between the bottom wall surface (44) in the suction-side portion (45) of the spiral groove (41) and the tip end surface of the gate (51) is ensured. This reduces not only the power consumed due to the slide of the side surface of the gate (51) on the side wall surface (42, 43) of the spiral groove (41), but also the power consumed due to the slide of the tip end surface of the gate (51) on the bottom wall surface (44) of the spiral groove (41).

A sixth aspect of the invention is intended for the single screw compressor of the fourth aspect of the invention, in which, in the screw rotor (40), only the side wall surface (42) of a pair of the side wall surfaces of the spiral groove (41), which is positioned on a front side in a traveling direction of the gate (51) is partially removed so that the clearance between the side wall surface (42, 43) in the suction-side portion (45) and the gate (51) is wider than that between the side wall surface (42, 43) in the discharge-side portion (46) and the gate (51).

In the sixth aspect of the invention, only the side wall surface (42) of a pair of the side wall surfaces of the spiral groove (41), which is positioned on the front side in the traveling direction of the gate (51) is partially removed, thereby making the clearance between the side wall surface (42, 43) in the suction-side portion (45) and the gate (51) wider than that between the side wall surface (42, 43) in the discharge-side portion (46) and the gate (51).

A seventh aspect of the invention is intended for the single screw compressor of the first or second aspect of the invention, in which a distance from a central rotation axis of the gate rotor (50) to the bottom wall surface (44) in the discharge-side portion (46) is made longer than that from the central rotation axis of the gate rotor (50) to the tip end surface of the gate (51) so that the tip end surface of the gate (51) contacts the bottom wall surface (44) in the discharge-side portion (46) only during an operation of the single screw compressor.

In the seventh aspect of the invention, the distance from the central rotation axis of the gate rotor (50) to the bottom wall surface (44) in the discharge-side portion (46) is longer than that from the central rotation axis of the gate rotor (50) to the tip end surface of the gate (51). In the screw rotor (40) of the present invention, the depth of the spiral groove (41) is set to a value so that the bottom wall surface (44) of the spiral groove (41) contacts the tip end surface of the gate (51) only during the operation of the single screw compressor (1).

A eighth aspect of the invention is intended for the single screw compressor of any one of the first to seventh aspects of the invention, in which the plurality of gate rotors (50) are arranged at equal angular interval about a central rotation axis of the screw rotor (40).

In the eighth aspect of the invention, the plurality of gate rotors (50) are to be engaged with the single screw rotor (40).

Advantages of the Invention

In the first aspect of the invention, the clearance between the wall surface in the suction-side portion (45) of the spiral groove (41) and the gate (51) is wider than that between the wall surface in the discharge-side portion (46) and the gate (51). In addition, in the second aspect of the invention, the both side surfaces and tip end surface of the gate (51) contact the wall surfaces in the discharge-side portion (46) of the spiral groove (41), and there is a certain width of space between the wall surface in the suction-side portion (45) of the spiral groove (41) and the gate (51). That is, according to these aspects of the invention, when the internal pressure in the compression chamber (23) is somewhat high, the hermeticity in the compression chamber (23) is maintained, thereby reducing the leak of the fluid from the compression chamber (23). On the other hand, when the internal pressure in the compression chamber (23) is not so high, the clearance between the wall surface of the spiral groove (41) and the gate (51) is enlarged, thereby reducing the sliding resistance therebetween.

Consequently, according to the present invention, the amount of the fluid leaking from the compression chamber (23) is reduced, thereby ensuring a sufficient flow rate of fluid discharged from the single screw compressor (1). In addition, the power consumed due to the slide of the gate rotor (50) in the screw rotor (40) is reduced, thereby reducing power consumption of the single screw compressor.

In the third aspect of the invention, the clearance between the wall surface in the suction-side portion (45) of the spiral groove (41) and the gate (51) is gradually changed, considering the hermeticity required in the compression chamber (23), which becomes higher as the gate (51) relatively moves in the spiral groove (41). Consequently, according to the present invention, both reductions in the leakage of the fluid from the compression chamber (23), and in the sliding resistance between the screw rotor (40) and the gate rotor (50) can be achieved at higher level.

During the operation of the single screw compressor (1), pre-compressed low-temperature refrigerant or compressed high-temperature refrigerant flows in the single screw compressor (1). This makes temperatures in portions of the single screw compressor (1) different from each other, thereby making thermal deformation amount in such portions different from each other. Thus, a state in which, when the screw compressor (1) is stopped, the temperatures in the portions thereof are approximately the same (hereinafter referred to as a "room temperature state") differs from a state in which, when the screw compressor (1) is operated, the temperatures in the portions thereof are different from each other (hereinafter referred to as an "operating temperature state"), in shapes of the screw rotor (40) and gate rotors (50) themselves, and in a relative position between the screw rotor (40) and the gate rotor (50). In certain instances, the tip end surface of the gate (51) is firmly pushed against the bottom wall surface (44) of the spiral groove (41) of the screw rotor (40), resulting in an increase in frictional resistance therebetween in such a state.

On the other hand, in the seventh aspect of the invention, the distance from the central rotation axis of the gate rotor (50) to the bottom wall surface (44) in the discharge-side portion (46) is made longer than that from the central rotation axis of the gate rotor (50) to the tip end surface of the gate (51) so that the tip end surface of the gate (51) does not contact the screw rotor (40) in the room temperature state, and so that the tip end surface of the gate (51) contacts the screw rotor (40) only during the operation of the single screw compressor (1) which is in the operating temperature state.

Consequently, according to the seventh aspect of the invention, frictional resistance between the screw rotor (40) and the gate rotor (50) can be reduced even if the "shapes of the screw rotor (40) and gate rotors (50) themselves" or the "relative position between the screw rotor (40) and the gate rotor (50)" is changed from the room temperature state to the operating temperature state during the operation of the single screw compressor (1), resulting in the narrowed space between the bottom wall surface (44) of the spiral groove (41) of the screw rotor (40) and the tip end surface of the gate (51).

BRIEF DESCRIPTION OF THE DRAWINGS

FIG. 7 are plan views illustrating operations of a compression mechanism of the single screw compressor.

FIG. 13 are cross-sectional views illustrating a main part of a single screw compressor of Modified Example 3 in a plan containing a central rotation axis of a screw rotor. FIG. 13(A) illustrates a state at room temperature. FIG. 13(B) illustrates a state at operating temperature.

DESCRIPTION OF REFERENCE CHARACTERS

1 Single Screw Compressor
10 Casing
23 Compression Chamber
40 Screw Rotor
41 Spiral Groove
42 First Side Wall Surface
43 Second Side Wall Surface
44 Bottom Wall Surface
45 Suction-Side Portion
46 Discharge-Side Portion
50 Gate Rotor
51 Gate

DESCRIPTION OF EMBODIMENTS

Embodiments of the present invention will be described hereinafter in detail with reference to the drawings.

A single screw compressor (1) of the present embodiment (hereinafter simply referred to as a "screw compressor") compresses refrigerant, which is provided in a refrigerant circuit in which a refrigeration cycle is performed.

Figure 1:
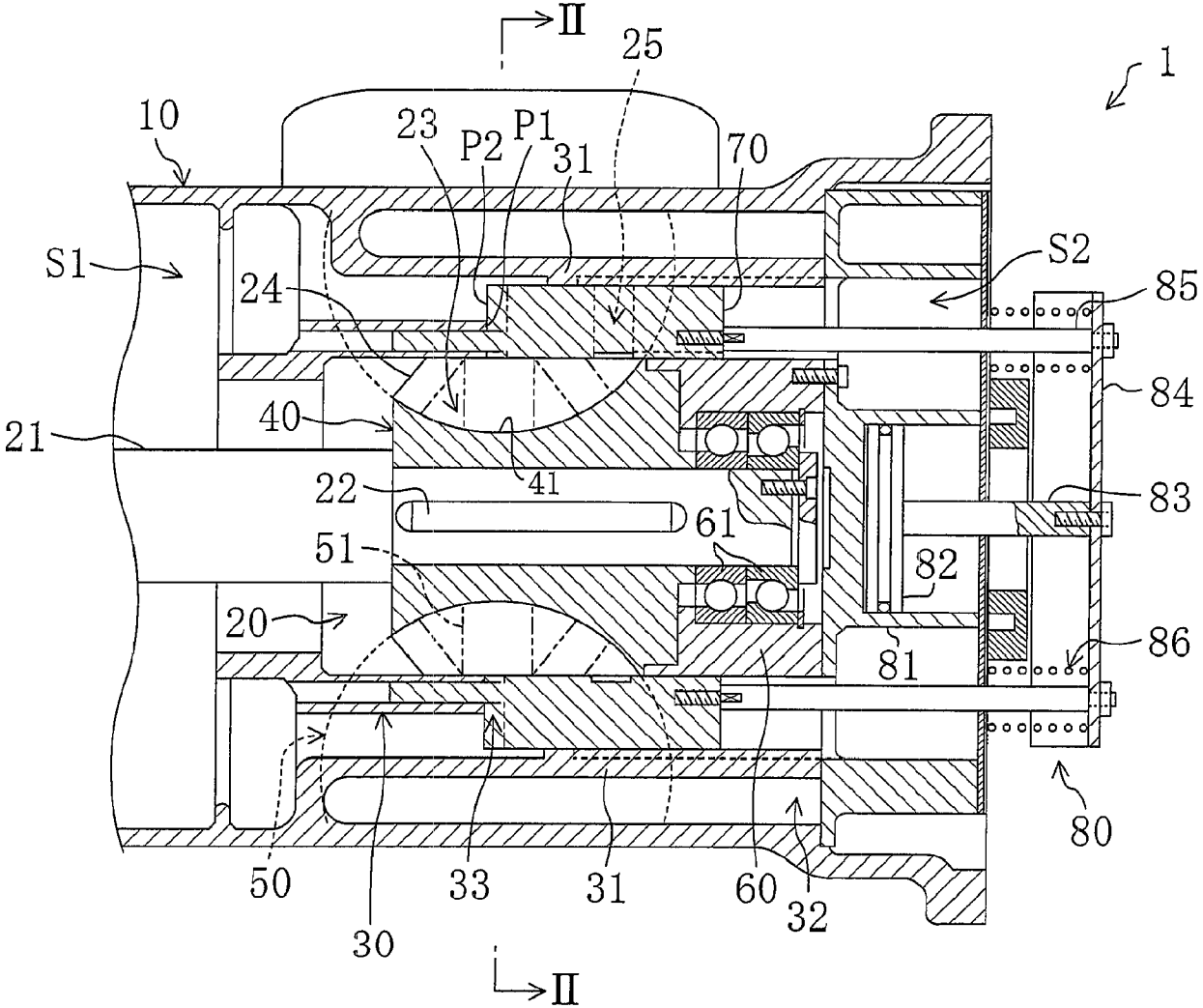
FIG. 1 is a longitudinal sectional view illustrating a structure including a main part of a single screw compressor.
Figure 2:
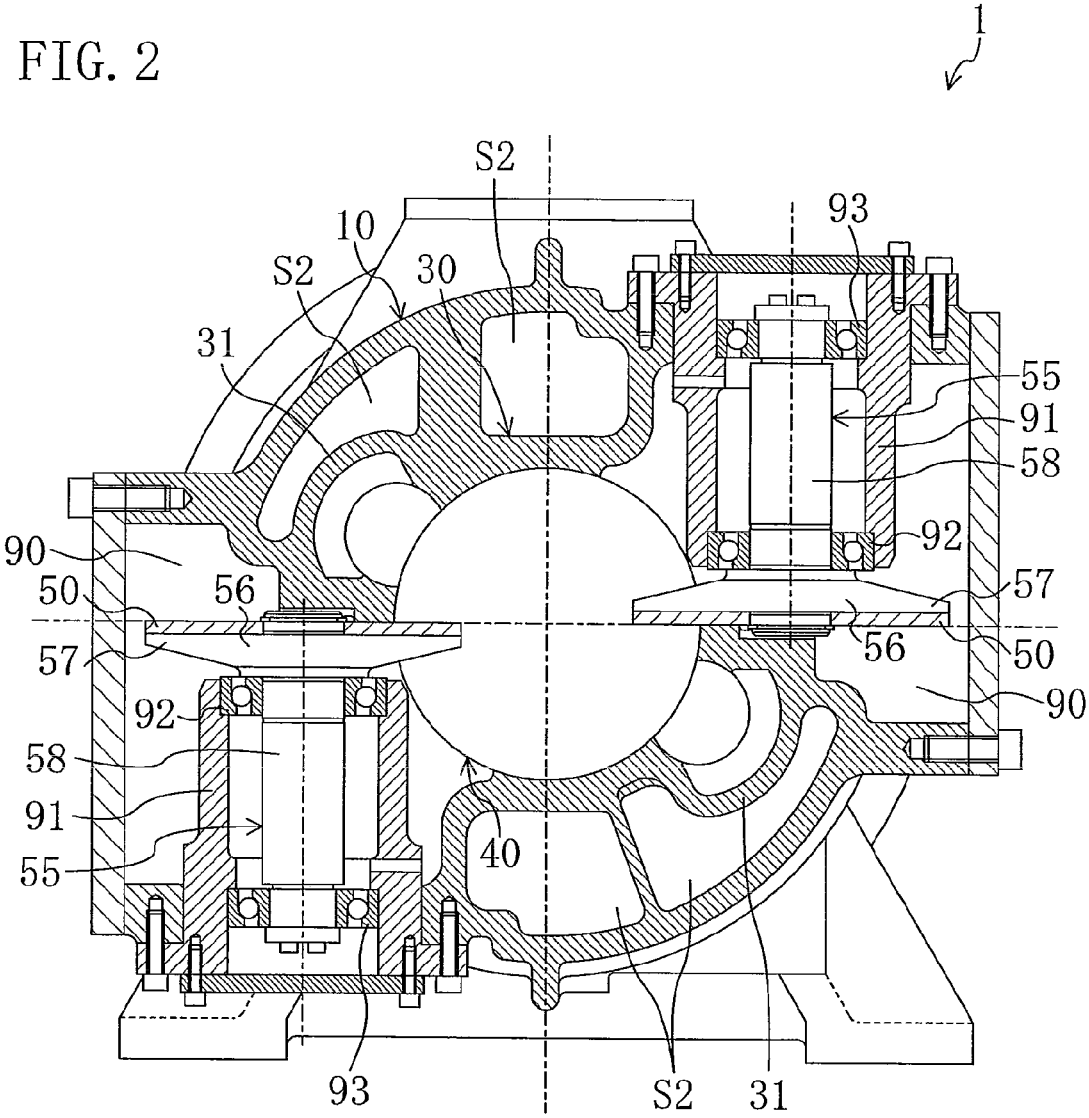
FIG. 2 is an II-II cross-sectional view of FIG. 1.

As illustrated in FIGS. 1 and 2, the screw compressor (1) is semi-hermetic. In the screw compressor (1), a compression mechanism (20) and an electric motor driving the compression mechanism (20) are accommodated in a single casing (10). The compression mechanism (20) is connected to the electric motor by a drive shaft (21). In FIG. 1, the electric motor is omitted. In addition, the casing (10) is formed so as to be divided into a low-pressure space (S1) to which low-pressure gas refrigerant is introduced from an evaporator of the refrigerant circuit, and which guides the low-pressure gas to the compression mechanism (20); and a high-pressure space (S2) into which high-pressure gas refrigerant discharged from the compression mechanism (20) flows.

The compression mechanism (20) includes a cylindrical wall (30) formed in the casing (10); a single screw rotor (40) arranged in the cylindrical wall (30); and two gate rotors (50) to be engaged with the screw rotor (40). The drive shaft (21) is inserted through the screw rotor (40). The screw rotor (40) and the drive shaft (21) are connected to each other by a key (22). The drive shaft (21) and the screw rotor (40) are coaxially arranged. A tip end portion of the drive shaft (21) is rotatably supported by a bearing holder (60) positioned on a high-pressure side of the compression mechanism (20) (on a right side in an axial direction of the drive shaft (21) as viewed in FIG. 1). The bearing holder (60) supports the drive shaft (21) by ball bearings (61).

Figure 3:
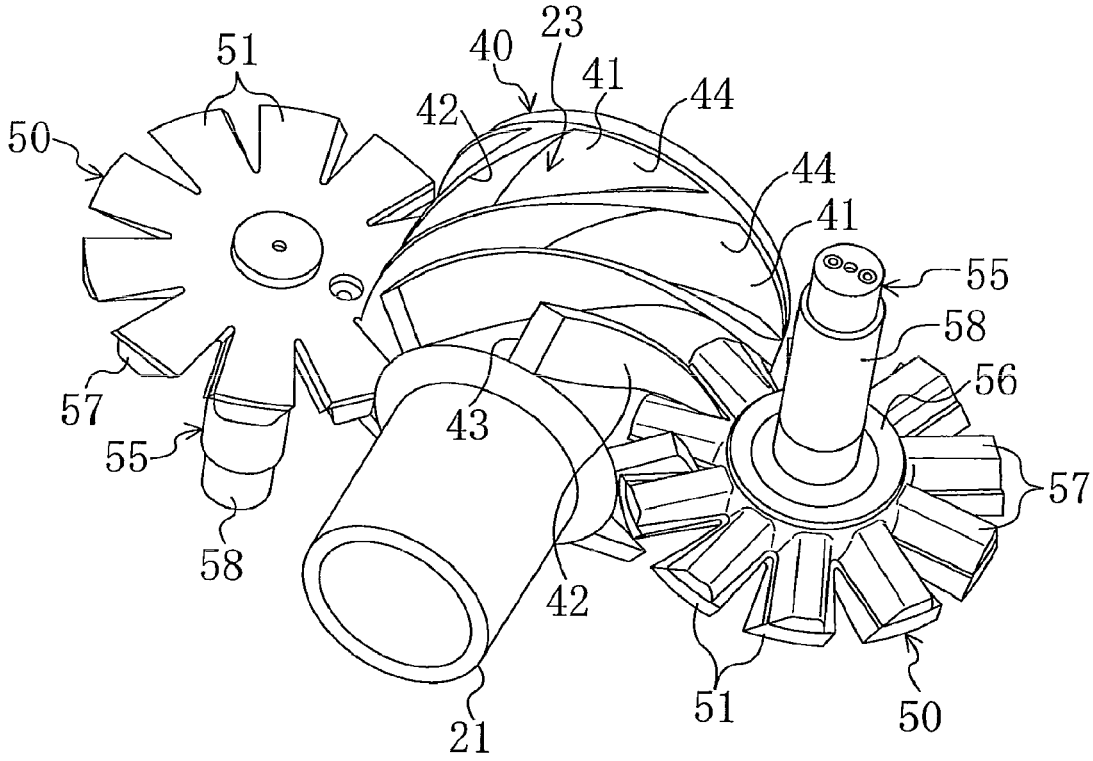
FIG. 3 is a perspective view focusing on the main part of the single screw compressor.
Figure 4:
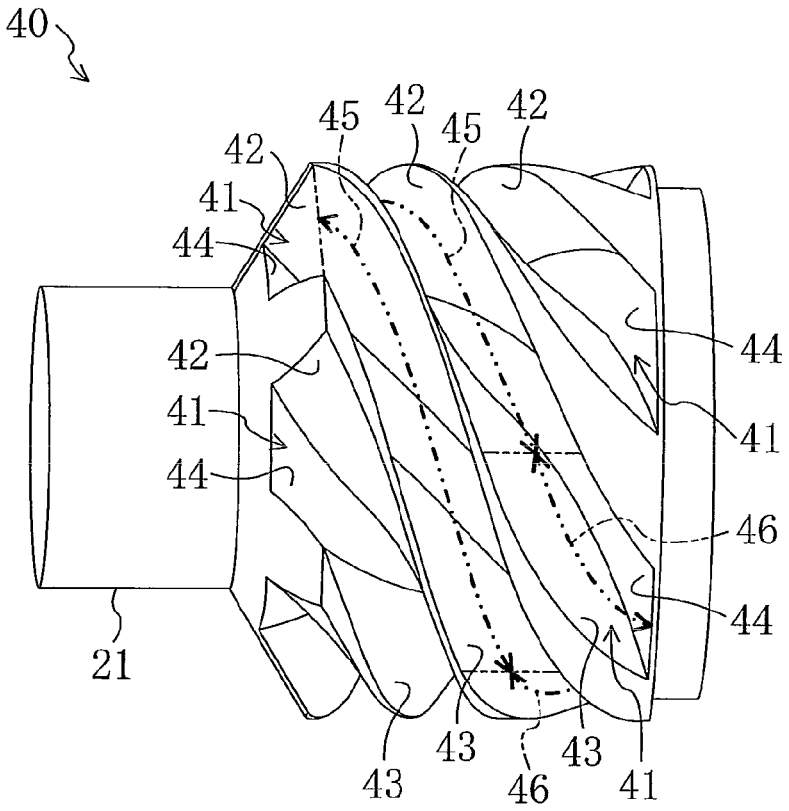
FIG. 4 is a perspective view illustrating a screw rotor of the single screw compressor.

As illustrated in FIGS. 3 and 4, the screw rotor (40) is a metal member formed in an approximately cylindrical shape. The screw rotor (40) is rotatably fitted to the cylindrical wall (30), and an outer circumferential surface thereof slidably contacts an inner circumferential surface of the cylindrical wall (30). A plurality of spiral grooves (41) (in the present embodiment, 6 spiral grooves) spirally extending from one end of the screw rotor (40) to the other end are formed in the outer circumference of the screw rotor (40).

As viewed in FIG. 4, a left end of each spiral groove (41) of the screw rotor (40) is a start point, and a right end is a terminal point. In addition, a left end portion of the screw rotor (40) as viewed in FIG. 4 (end portion on a suction side) is formed so as to be tapered. In the screw rotor (40) illustrated in FIG. 4, the start point of the spiral groove (41) opens at the left end surface which is formed so as to be tapered, and the terminal point of the spiral groove (41) does not open at the right end surface.

One of side wall surfaces (42, 43) on both sides of the spiral groove (41), which is positioned on a front side in a traveling direction of gates (51) (on the right side as viewed in FIG. 4), is the first side wall surface (42), and the other which is positioned on a rear side in the traveling direction of the gates (51) (on the left side as viewed in FIG. 4) is the second side wall surface (43). Each spiral groove (41) is formed with a suction-side portion (45) and a discharge-side portion (46). These will be described later.

Each gate rotor (50) is a resin member in which a plurality of gates (51) (in the present embodiment, 11 gates) formed in a rectangular plate-like shape are radially provided. The gate rotors (50) are arranged on an outer side of the cylindrical wall (30) so as to be axisymmetrical about a rotation axis of the screw rotor (40). That is, in the screw compressor (1) of the present embodiment, two gate rotors (50) are arranged at equal angular interval (in the present embodiment, at angular interval of 180°) about a central rotation axis of the screw rotor (40). A central axis of each gate rotor (50) is perpendicular to a central axis of the screw rotor (40). Each gate rotor (50) is arranged such that the gates (51) are engaged with the spiral grooves (41) of the screw rotor (40) with the gates (51) penetrating through a part of the cylindrical wall (30).

The gate rotor (50) is attached to a rotor support (55) made of metal (see FIG. 3). The rotor support (55) includes a base (56), arms (57), and a shaft (58). The base (56) is formed in a slightly-thick disc-like shape. There are the same number of arms (57) as that of gates (51) of the gate rotor (50), and the arms (57) radially and outwardly extend from an outer circumferential surface of the base (56). The shaft (58) is formed in a rod-like shape, and is vertically arranged on the base (56). A central axis of the shaft (58) matches a central axis of the base (56). The gate rotor (50) is attached to a surface on a side opposite to the shaft (58) with respect to the base (56) and the arms (57). Each arm (57) contacts a back surface of the gate (51).

The rotor supports (55) to which the gate rotors (50) are attached are accommodated in gate rotor chambers (90) defined and formed near the cylindrical wall (30) in the casing (10) (see FIG. 2). The rotor support (55) arranged on the right side of the screw rotor (40) as viewed in FIG. 2 is installed with the gate rotor (50) being arranged on a lower end side. On the other hand, the rotor support (55) arranged on the left side of the screw rotor (40) as viewed in FIG. 2 is installed with the gate rotor (50) being arranged on an upper end side. The shaft (58) of each rotor support (55) is rotatably supported by the ball bearings (92, 93) in a bearing housing (91) of the gate rotor chamber (90). Each gate rotor chamber (90) communicates with the low-pressure space (S1).

In the compression mechanism (20), a space surrounded by the inner circumferential surface of the cylindrical wall (30), the spiral groove (41) of the screw rotor (40), and the gate (51) of the gate rotor (50) defines a compression chamber (23). A suction-side end portion of the spiral groove (41) of the screw rotor (40) opens to the low-pressure space (S1), and such an opening portion functions as a suction port (24) of the compression mechanism (20).

The screw compressor (1) is provided with slide valves (70) as a capacity control mechanism. The slide valves (70) are provided in slide valve accommodating portions (31) where two portions of the cylindrical wall (30) in the circumferential direction thereof outwardly protrude in a radial direction. An inner surface of the slide valve (70) defines a part of the inner circumferential surface of the cylindrical wall (30), and the slide valve (70) is configured so as to slide in an axial direction of the cylindrical wall (30).

When sliding the slide valve (70) toward the high-pressure space (S2) (toward the right side in the axial direction of the drive shaft (21) as viewed in FIG. 1), a space is axially formed between an end surface (P1) of the slide valve accommodating portion (31) and an end surface (P2) of the slide valve (70). Such an axially-formed space functions as a bypass path (33) for returning refrigerant from the compression chamber (23) to the low-pressure space (S1). When changing the degree of opening of the bypass path (33) by moving the slide valve (70), the capacity of the compression mechanism (20) is changed. The slide valve (70) is formed with a discharge port (25) for making the compression chamber (23) communicate with the high-pressure space (S2).

A slide valve drive mechanism (80) for slidably driving the slide valve (70) is provided in the screw compressor (1). The slide valve drive mechanism (80) includes a cylinder (81) fixed to the bearing holder (60); a piston (82) loaded in the cylinder (81); an arm (84) connected to a piston rod (83) of the piston (82); connecting rods (85) for connecting the arm (84) to the slide valves (70); and springs (86) for biasing the arm (84) to the right as viewed in FIG. 1 (in a direction of separating the arm (84) from the casing (10)).

In the slide valve drive mechanism (80) illustrated in FIG. 1, an internal pressure in a space on the left side of the piston (82) (space on the screw rotor (40) side with respect to the piston (82)) is higher than that in a space on the right side of the piston (82) (space on the arm (84) side with respect to the piston (82)). The slide valve drive mechanism (80) is configured to adjust a position of the slide valve (70) by adjusting the internal pressure in the space on the right side of the piston (82) (i.e., gas pressure in the right-side space).

During the operation of the screw compressor (1), suction pressure of the compression mechanism (20) acts on one axial end surface of the slide valve (70), and discharge pressure of the compression mechanism (20) acts on the other. This makes a force in a direction of pushing the slide valve (70) toward the low-pressure space (S1) side constantly act on the slide valve (70) during the operation of the screw compressor (1). Consequently, when changing the internal pressure in the spaces on the left and right side of the piston (82) in the slide valve drive mechanism (80), the magnitude of a force in a direction of pulling the slide valve (70) toward the high-pressure space (S2) side is changed, thereby changing the position of the slide valve (70).

Figure 5:
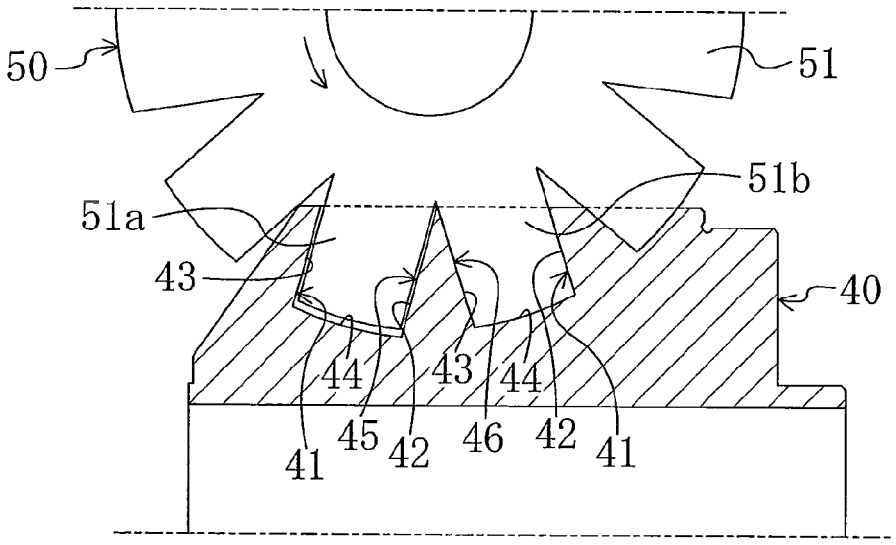
FIG. 5 is a cross-sectional view illustrating the main part of the single screw compressor in a plan containing a central rotation axis of the screw rotor.

As described above, the spiral groove (41) of the screw rotor (40) is formed with the suction-side portion (45) and the discharge-side portion (46). The suction-side portion (45) and the discharge-side portion (46) will be described with reference to FIGS. 4-6. FIG. 5 illustrates a state in which a gate (51*a*) is positioned in the suction-side portion (45) of the spiral groove (41), and in which a gate (51*b*) is positioned in the discharge-side portion (46) of the spiral groove (41). In addition, FIG. 6 is a development view of the screw rotor (40).

Figure 6:
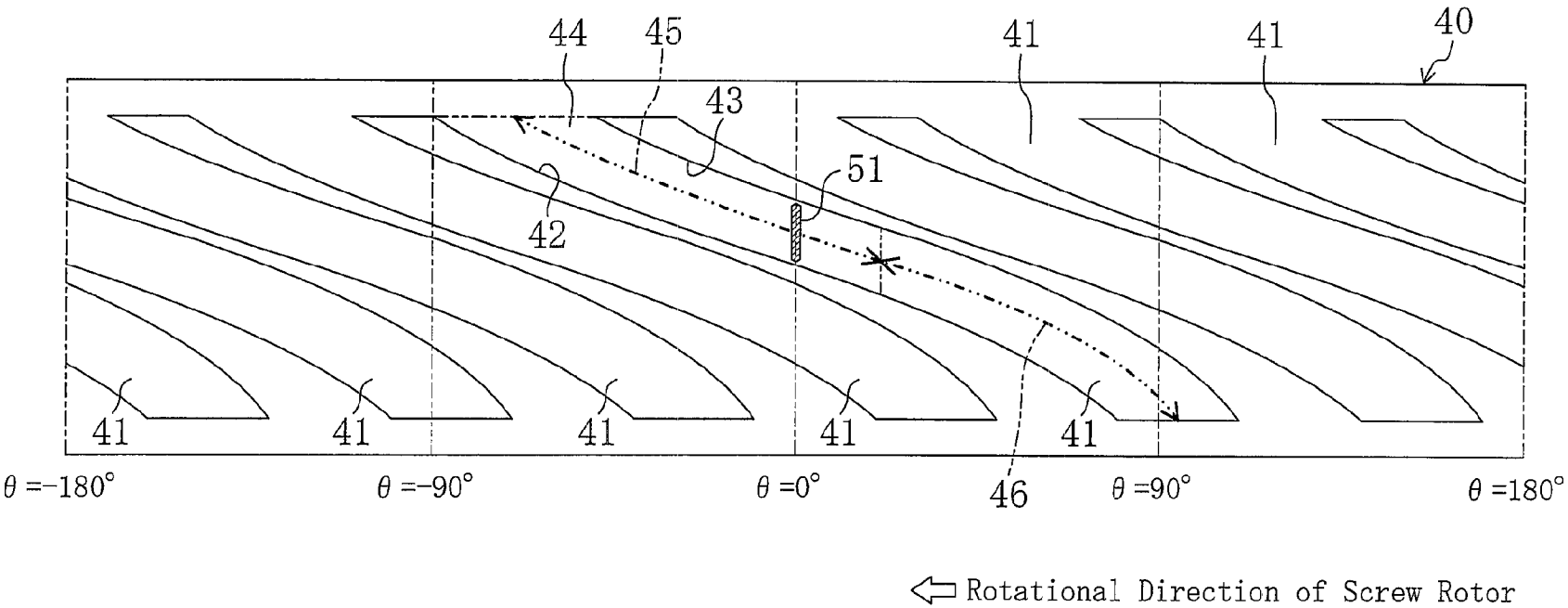
FIG. 6 is a development view of the screw rotor illustrated in FIG. 4.

An angle θ in FIG. 6 represents an angle about the central rotation axis of the screw rotor (40). The angle θ is 0° (zero degree) at a position where a "line $L_1$ connecting the center in the width direction of the gate (51) relatively moving in the spiral groove (41), to the rotational center O of the gate rotor (50)" is perpendicular to a "central rotation axis $L_2$ of the screw rotor (40)" (see FIG. 10). The angle θ is positive (+) when the screw rotor (40) rotates in its rotational direction, and is negative (−) when the screw rotor (40) rotates in a direction opposite to the rotational direction.

As illustrated in FIGS. 4 and 6, in each spiral groove (41), a portion extending from the start point to a position in a compression stroke defines the suction-side portion (45), and the remaining portion (i.e., portion extending from the position in the compression stroke to the terminal point) defines the discharge-side portion (46). That is, in each spiral groove (41), an area up to a point at which the compression chamber (23) is completely closed, and an area corresponding to a part of the compression stroke are the suction-side portion (45), and areas corresponding to the remaining part of the compression stroke, and to all parts of a discharge stroke are the discharge-side portion (46).

In the spiral groove (41), the portion corresponding to the compression stroke means a portion extending from a position of the gate (51) at the time of the completely-closed state in which the compression chamber (23) is blocked off from the low-pressure space (S1) by the gate (51), to a position of the gate (51) immediately before start of communication between the compression chamber (23) and the discharge port (25). In addition, in the spiral groove (41), the portion corresponding to the discharge stroke means a portion extending from the position of the gate (51) at the time of the start of the communication between the compression chamber (23) and the discharge port (25), to the terminal point of the spiral groove (41).

As illustrated in FIG. 5, in the discharge-side portion (46) of the spiral groove (41), there is almost no clearance between the side wall surfaces (42, 43) on both side of the discharge-side portion (46) and a bottom wall surface (44), and the gate (51). That is, in the discharge-side portion (46), the wall surfaces (42, 43, 44) of the spiral groove (41) substantially contact the gate (51). Specifically, in the discharge-side portion (46) of the spiral groove (41), the width of the spiral groove (41) in a cross section containing the rotation axis of the screw rotor (40) (cross section illustrated in FIG. 5) is approximately the same as that of the gate (51). In addition, in the discharge-side portion (46), the distance from the rotation axis of the gate rotor (50) to the bottom wall surface (44) of the spiral groove (41) is approximately the same as that from the rotation axis of the gate rotor (50) to a tip end surface of the gate (51).

However, in the discharge-side portion (46) of the spiral groove (41), the wall surfaces (42, 43, 44) of the spiral groove (41) is not required to physically contact the gate (51), and there may be no problem if a minute space is present between the wall surface (42, 43, 44) and the gate (51). If such a space can be sealed by an oil film made of lubricant oil, hellueticity in the compression chamber (23) can be maintained without the physical contact between the wall surface (42, 43, 44) and the gate (51).

In the suction-side portion (45) of the spiral groove (41), the clearances between the side wall surfaces (42, 43) on both sides of the suction-side portion (45) and the gate (51) are wider than those between the side wall surfaces (42, 43) in the discharge-side portion (46) and the gate (51). The clearance between the side wall surface (42, 43) in the suction-side portion (45) and the gate (51) is gradually narrowed as the gate (51) moves from the start point to the terminal point in the spiral groove (41). Specifically, in the suction-side portion (45) of the spiral groove (41), the width of the spiral groove (41) in the cross section containing the rotation axis of the screw rotor (40) (cross section illustrated in FIG. 5) is somewhat wider than that of the gate (51), and is gradually narrowed from the start point to the terminal point in the spiral groove (41).

In the suction-side portion (45) of the spiral groove (41), the clearance between the bottom wall surface (44) in the suction-side portion (45) and the gate (51) is wider than that between the bottom wall surface (44) in the discharge-side portion (46) and the gate (51). The clearance between the bottom wall surface (44) in the suction-side portion (45) and the gate (51) is gradually narrowed as the gate (51) moves from the start point to the terminal point in the spiral groove (41). Specifically, in the suction-side portion (45) of the spiral groove (41), the distance from the rotation axis of the gate rotor (50) to the bottom wall surface (44) of the spiral groove (41) is somewhat longer than that from the rotation axis of the gate rotor (50) to the tip end surface of the gate (51), and is gradually shortened from the start point to the terminal point in the spiral groove (41).

In the suction-side portion (45) of the spiral groove (41), the space between the wall surface (42, 43, 44) of the spiral groove (41) and the gate (51) is sealed to some extent by the oil film made of lubricant oil. A differential pressure between front and back sides of the gate (51) positioned in the suction-side portion (45) is smaller than that between the front and back sides of the gate (51) positioned in the discharge-side portion (46). Consequently, in the suction-side portion (45) of the spiral groove (41), even if the space between the wall surface (42, 43, 44) of the spiral groove (41) and the gate (51) has the certain width, the hermeticity in the compression chamber (23) can be maintained.

In the suction-side portion (45) of the spiral groove (41), a clearance between the wall surface (42, 43, 44) of the spiral groove (41) and the gate (51) in the area of the spiral groove (41), which extends from the start point to the position of the gate (51) at the time of completely closing the compression chamber (23), is much wider than that in the remaining area. In the area of the spiral groove (41), which extends from the start point to the position of the gate (51) at the time of completely closing the compression chamber (23), the clearance between the wall surface (42, 43, 44) of the spiral groove (41) and the gate (51) is not necessarily changed, and may be fixed.

Operation

The operation of the single screw compressor (1) will be described.

When starting the electric motor in the single screw compressor (1), the screw rotor (40) rotates in response to rotation of the drive shaft (21). The gate rotors (50) also rotate in response to the rotation of the screw rotor (40), and the compression mechanism (20) repeats suction, compression, and discharge strokes. A compression chamber (23) which is shaded portion in FIGS. 7 will be described hereinafter.

Figure 7A:
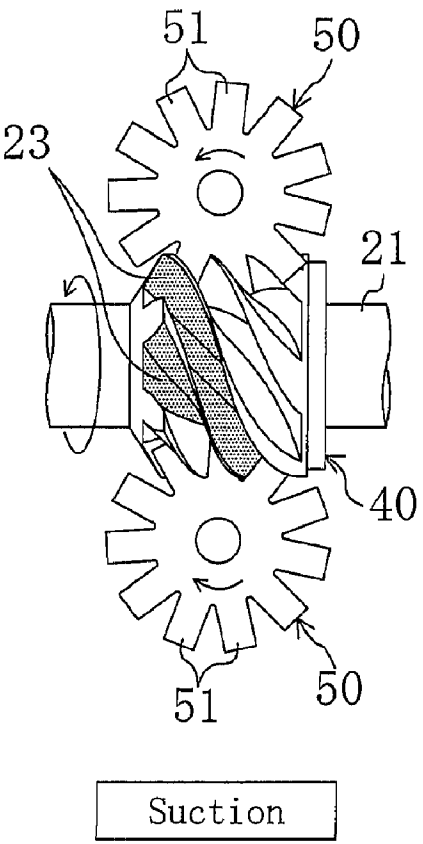
FIG. 7(A) illustrates a suction stroke.

In FIG. 7(A), the shaded compression chambers (23) communicate with the low-pressure space (S1). The spiral grooves (41) in which such compression chambers (23) are formed are engaged with the gates (51) of the gate rotor (50) positioned on a lower side as viewed in FIG. 7(A). When rotating the screw rotor (40), the gates (51) relatively move toward the terminal points of the spiral grooves (41), and then the volume of the compression chamber (23) increases in response thereto. Consequently, the low-pressure gas refrigerant in the low-pressure space (S1) is sucked into the compression chamber (23) through the suction port (24).

Figure 7B:
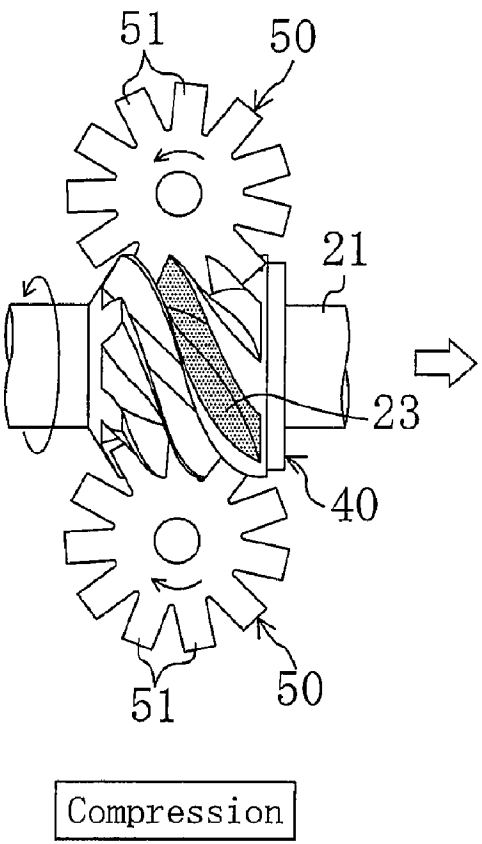
FIG. 7(B) illustrates a compression stroke.

A further rotation of the screw rotor (40) brings a state illustrated in FIG. 7(B). In FIG. 7(B), the shaded compression chamber (23) is in the completely-closed state. That is, the spiral groove (41) in which such a compression chamber (23) is formed is engaged with the gate (51) of the gate rotor (50) positioned on an upper side as viewed in FIG. 7(B), and is separated from the low-pressure space (S1) by the gate (51). When the gate (51) relatively moves toward the terminal point of the spiral groove (41) in response to the rotation of the screw rotor (40), the volume of the compression chamber (23) is gradually reduced. Consequently, the gas refrigerant in the compression chamber (23) is compressed.

Figure 7C:
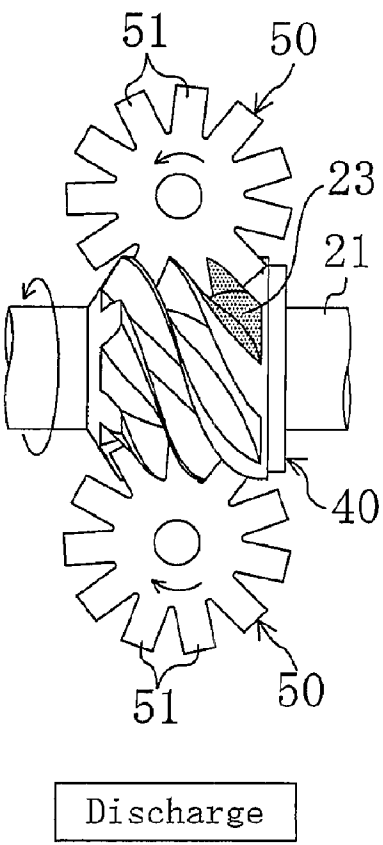
FIG. 7(C) illustrates a discharge stroke.

A further rotation of the screw rotor (40) brings a state illustrated in FIG. 7(C). In FIG. 7(C), the shaded compression chamber (23) communicates with the high-pressure space (S2) through the discharge port (25). When the gate (51) relatively moves toward the terminal point of the spiral groove (41) in response to the rotation of the screw rotor (40), the compressed gas refrigerant is pushed from the compression chamber (23) to the high-pressure space (S2).

At this point, in the compression mechanism (20), the compression chamber (23) surrounded by the spiral groove (41) of the screw rotor (40) and the cylindrical wall (30) of the casing (10) is divided into two portions by the gate (51). In the compression chamber (23) divided by the gate (51), one portion communicates with the low-pressure space (S1), and the other portion is a closed space or communicates with the high-pressure space (S2). During the compression stroke of the compression mechanism (20), the internal pressure in the compression chamber (23) which is the closed space gradually increases, thereby increasing the differential pressure between the front and back sides of the gate (51). On the other hand, during the discharge stroke of the compression mechanism (20), in the compression chamber (23) divided into two portions by the gate (51), the internal pressure in one portion is approximately equal to that in the high-pressure space (S2), and the internal pressure in the other portion is approximately equal to that in the low-pressure space (S1).

As described above, in the compression mechanism (20), the differential pressure between the front and back sides of the gate (51) gradually increases during the compression stroke, and the differential pressure between the front and back sides of the gate (51) is maintained at maximum value during the discharge stroke. That is, the hermeticity required in the compression chamber (23) gradually increases during the compression stroke of the compression mechanism (20), and the hermeticity required in the compression chamber (23) is maximum during the discharge stroke.

In the spiral groove (41) of the screw rotor (40) of the present embodiment, the clearance between the wail surface (42, 43, 44) in the suction-side portion (45) and the gate (51) is gradually narrowed as the gate (51) moves closer to the terminal point of the spiral groove (41), and the clearance between the wall surface (42, 43, 44) in the discharge-side portion (46) and the gate (51) is narrower than that in the suction-side portion (45). In the course of relatively moving the gate (51) from the start point toward the terminal point in the spiral groove (41), when the hermeticity in the compression chamber (23) is not necessarily high, the clearance between the wall surface (42, 43, 44) of the spiral groove (41) and the gate (51) is enlarged, thereby reducing sliding resistance between the screw rotor (40) and the gate (51). On the other hand, when the high hermeticity is required in the compression chamber (23), the clearance between the wall surface (42, 43, 44) of the spiral groove (41) and the gate (51) is narrowed, thereby maintaining the required hermeticity.

Method for Processing the Screw Rotor

The screw rotor (40) of the present embodiment is processed by using a 5-axis machining center (100) which is a 5-axis processor.

Figure 8:
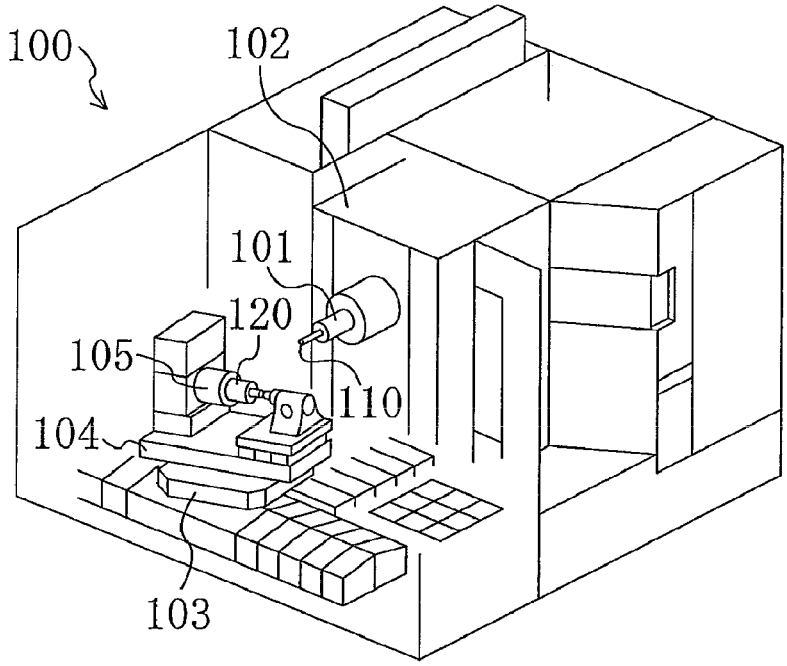
FIG. 8 is a perspective view schematically illustrating an entire structure of a 5-axis machining center used for processing the screw rotor.

As illustrated in FIG. 8, the 5-axis machining center (100) includes a main shaft (101) to which a cutting tool (110) such as end mills is attached; and a column (102) to which the main shaft (101) is attached. In addition, the 5-axis machining center (100) includes a rotatable table (104) rotatably attached to a base table (103); and a clamping portion (105) for clamping a work (120) being an object to be cut, which is installed on the rotatable table (104).

Figure 9:
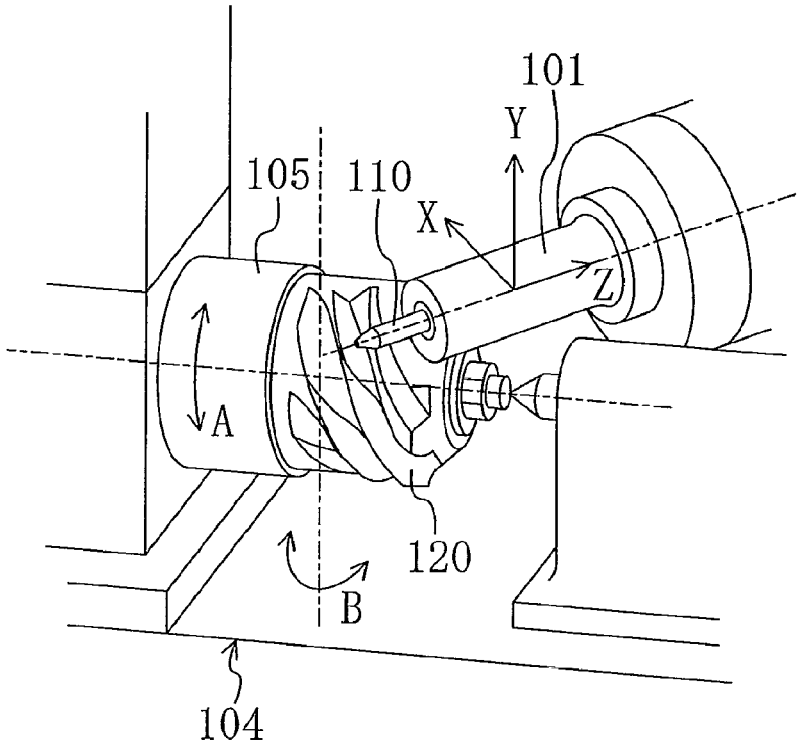
FIG. 9 is a perspective view schematically illustrating a main part of the 5-axis machining center used for processing the screw rotor.

As illustrated in FIG. 9, in the 5-axis machining center (100), three degrees of freedom are assigned to the tool side, and two degrees of freedom are assigned to the work (120) side. Specifically, the main shaft (101) is movable in an X-axis direction perpendicular to a rotation axis of the main shaft (101), a Y-axis direction perpendicular to the rotation axis and the X-axis direction, and a Z-axis direction which is the rotation axis direction. The clamping portion (105) is rotatable about its central axis (about an A axis). The rotatable table (104) to which the clamping portion (105) is attached is rotatable about an axis perpendicular to the axial direction of the clamping portion (105) (about a B axis). That is, in the 5-axis machining center (100), the cutting tool (110) is movable parallel to the X-axis, Y-axis, and Z-axis directions, whereas the work (120) is rotatable about the A and B axes.

In the 5-axis machining center (100), the cutting tool (110) is moved based on a tool path which is provided in advance as numerical data, thereby processing the work (120) which will be the screw rotor (40). The 5-axis machining center (100) sequentially performs a plurality of processes from a rough cut to a finish by using a plurality types of cutting tools (110).

The tool path in the finish processing is set so that the wall surfaces (42, 43, 44) in the suction-side portion (45) and in the discharge-side portion (46) are formed in a predetermined shape in the spiral groove (41) of the work (120) which will be the screw rotor (40). That is, in the finish processing, the tool path is set so that a cutting amount in the suction-side portion (45) is larger than that in discharge-side portion (46), and so that the cutting amount in suction-side portion (45) gradually decreases toward the terminal point of the spiral groove (41).

Advantages of the Embodiment

In the present embodiment, the both side surfaces and the tip end surface of the gate (51) contact the wall surfaces (42, 43, 44) of the spiral groove (41) in the discharge-side portion (46) of the spiral groove (41), whereas there is a certain width of space between the wall surface (42, 43, 44) of the spiral groove (41) and the gate (51) in the suction-side portion (45)

of the spiral groove (41). That is, when the internal pressure in the compression chamber (23) is somewhat high, and the differential pressure between the front and back sides of the gate (51) is relatively large, the hermeticity in the compression chamber (23) is maintained, thereby preventing the leak of the gas refrigerant from the compression chamber (23). On the other hand, when the internal pressure in the compression chamber (23) is not so high, and the differential pressure between the front and back sides of the gate (51) is relatively small, the clearance between the wall surface of the spiral groove (41) and the gate (51) is enlarged, thereby reducing the sliding resistance therebetween.

Consequently, according to the present embodiment, the amount of the refrigerant leaking from the compression chamber (23) is reduced, thereby ensuring a sufficient flow rate of the refrigerant discharged from the single screw compressor (1). In addition, power consumed due a slide of the gate rotors (50) in the screw rotor (40) is reduced, thereby reducing the power consumption of the single screw compressor (1).

In the present embodiment, the clearance between the wall surface (42, 43, 44) in the suction-side portion (45) of the spiral groove (41) and the gate (51) is gradually changed, considering the hermeticity required in the compression chamber (23), which becomes higher as the gate (51) relatively moves in the spiral groove (41). Consequently, according to the present embodiment, both reductions in the leakage of the fluid from the compression chamber (23), and in the sliding resistance between the screw rotor (40) and the gate rotor (50) can be achieved at higher level.

Modified Example 1 of Embodiment

In the screw rotor (40) of the above-described embodiment, the space is formed between the side wall surface (42, 43) in the suction-side portion (45) of the spiral groove (41) and a side surface of the gate (51), and the space is also formed between the bottom wall surface (44) in the suction-side portion (45) and the tip end surface of the gate (51). On the other hand, the space may be formed between the side wall surface (42, 43) in the suction-side portion (45) of the spiral groove (41) and the side surface of the gate (51), and the clearance between the bottom wail surface (44) in the suction-side portion (45) and the tip end surface of the gate (51) may be substantially set to zero. In this case, the power consumed due to the sliding resistance between the side wall surface (42, 43) of the spiral groove (41) and the side surface of the gate (51) is reduced, thereby reducing the power consumption of the screw compressor (1) as compared with the conventional screw compressors.

Modified Example 2 of Embodiment

Figure 10:
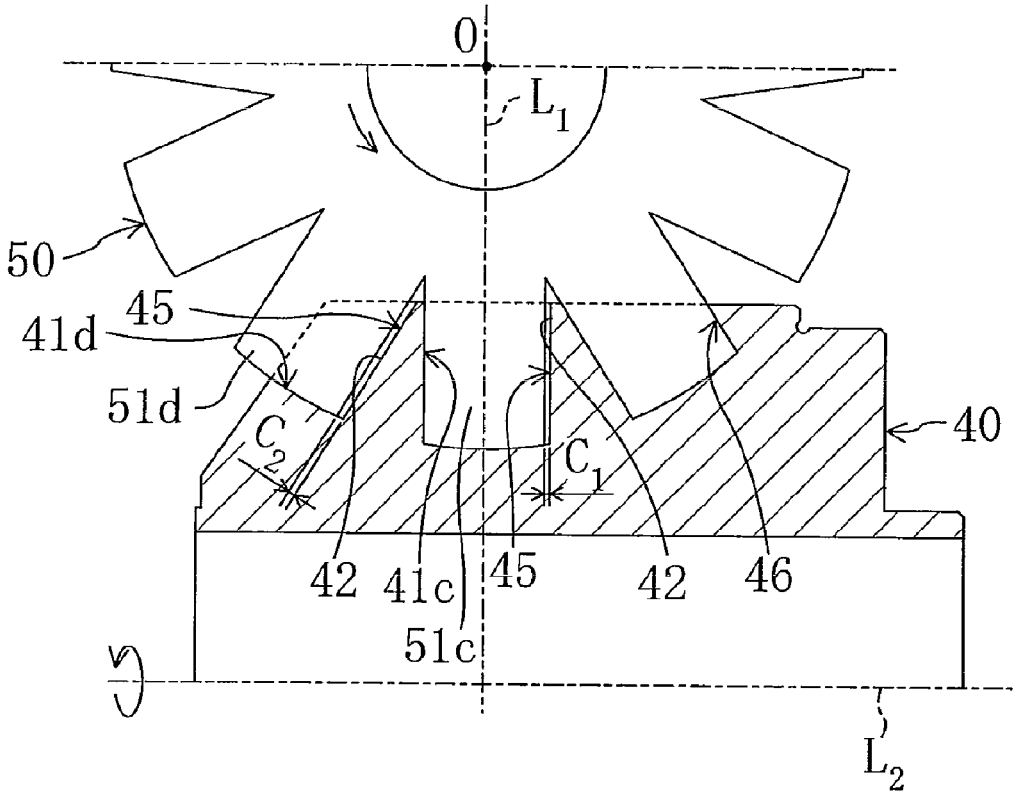
FIG. 10 is a cross-sectional view illustrating a main part of a single screw compressor of Modified Example 2 in a plan containing a central rotation axis of a screw rotor.

As illustrated in FIG. 10, in the screw compressor (1) of the above-described embodiment, a space may be formed only between the first side wall surface (42) of the spiral groove (41) of the screw rotor (40) (i.e., the side wall surface of the spiral groove (41), which is positioned on the front side in the traveling direction of the gate (51)) and the side surface of the gate (51).

In the screw rotor (40) illustrated in FIG. 10, the space is formed between a portion of the first side wall surface (42) corresponding to the suction-side portion (45) and the side surface of the gate (51); and the clearance between a portion of the first side wall surface (42) corresponding to the discharge-side portion (46) and the side surface of the gate (51) is substantially "0 (zero)." In addition, in the area of the spiral groove (41) of the screw rotor (40), which extends from the start point to the terminal point, the clearance between the second side wall surface (43) and the side surface of the gate (51) is substantially "0 (zero)," and the clearance between the bottom wall surface (44) and the tip end surface of the gate (51) is substantially "0 (zero)."

Figure 11:
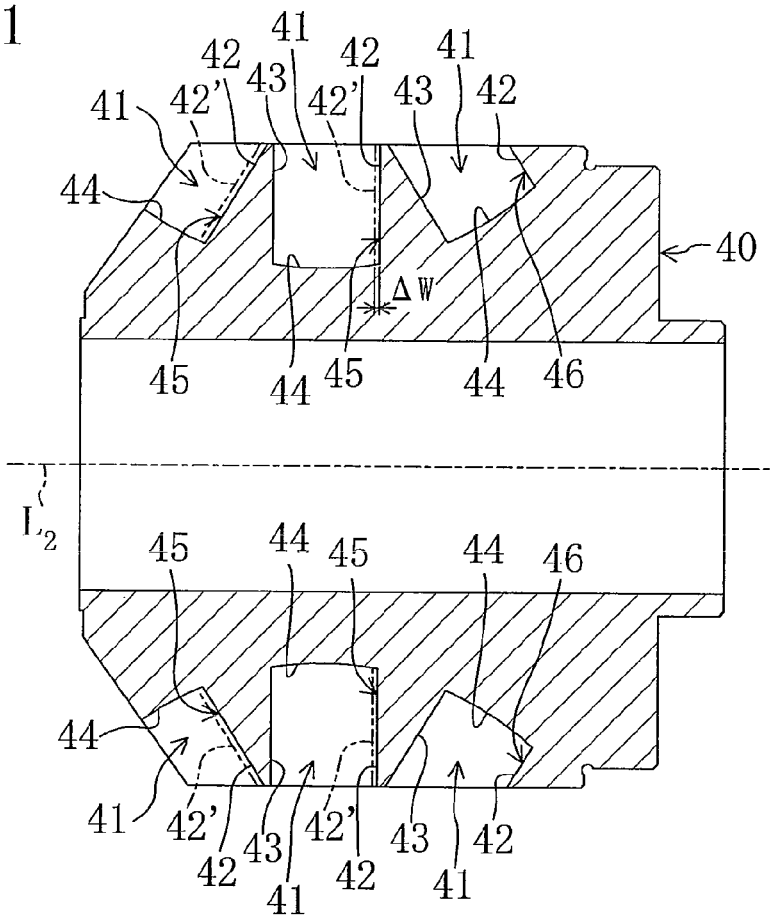
FIG. 11 is a view illustrating a cross section containing the central rotation axis of the screw rotor of Modified Example 2.

As illustrated in FIG. 11, in the screw rotor (40) of the present modified example, the first side wall surface (42) of the spiral groove (41) corresponding to the suction-side portion (45) is partially removed. Consequently, the groove width in the suction-side portion (45) of the spiral groove (41) is wider than the width of the gate (51). In FIG. 11, a chain double-dashed line indicates a virtual side wall surface (42') in the case of the spiral groove (41) having the same width as that of the gate (51). When setting the tool path of the cutting tool (110) in the 5-axis machining center (100), coordinates of the virtual side wall surface (42') are first calculated. Subsequently, the calculated coordinates of the virtual side wall surface (42') is moved by ΔW, thereby setting coordinates of the portion of the first side wall surface (42) corresponding to the suction-side portion (45).

Figure 12:
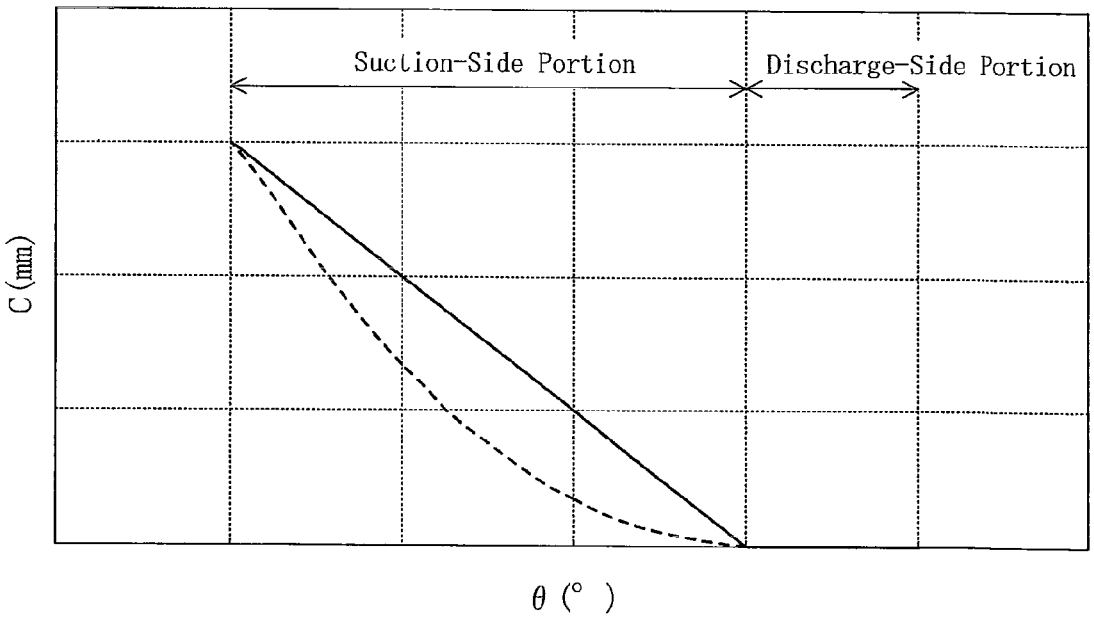
FIG. 12 is a relationship plot between a clearance C and an angle θ, which illustrates a change in the clearance C between a first side wall surface of the spiral groove and a side surface of the gate.

As illustrated in FIG. 12, in the screw compressor (1) of the present modified example, a clearance C between the first side wall surface (42) of the spiral groove (41) and the side surface of the gate (51) is substantially "0 (zero)" at a terminal point of the suction-side portion (45) (i.e., a boundary between the suction-side portion (45) and the discharge-side portion (46)), and gradually increases from the terminal point toward a start point of the suction-side portion (45). That is, the clearance between the portion of the first side wall surface (42) corresponding to the suction-side portion (45) and the side surface of the gate (51) is gradually narrowed toward the terminal point of the suction-side portion (45). Thus, in FIG. 10, a clearance $C_1$ between a first side wall surface (42) of a spiral groove (41*c*) and a side surface of a gate (51*c*) is narrower than a clearance $C_2$ between a first side wall surface (42) of a spiral groove (41*d*) and a side surface of a gate (51*d*).

In addition, as illustrated in FIG. 12, the clearance between the portion of the first side wall surface (42) corresponding to the discharge-side portion (46) and the side surface of the gate (51) is substantially "0 (zero)" in an area extending from a start point of the discharge-side portion (46) (i.e., the boundary between the suction-side portion (45) and the discharge-side portion (46)) to a terminal point of the discharge-side portion (46).

In the screw rotor (40) of the present modified example, the clearance C between the first side wall surface (42) of the spiral groove (41) and the side surface of the gate (51) may linearly increase from the terminal point of the suction-side portion (45) toward the start point of the suction-side portion (45) as illustrated by a solid line in FIG. 12, or may increase along a quadratic curve from the terminal point of the suction-side portion (45) toward the start point of the suction-side portion (45) as illustrated by a dashed line in FIG. 12.

Modified Example 3 of Embodiment

In the screw compressor (1) of the above-described embodiment, the screw rotor (40) may be formed with a space between the bottom wall surface (44) and the tip end surface of the gate (51) along the entire length of the spiral groove (41). It is preferred that the clearance between the portion of the bottom wall surface (44) corresponding to the discharge-side portion (46) and the tip end surface of the gate (51) is set to a value so that the bottom wall surface (44) contacts the gate (51) during the operation of the screw compressor (1).

At this point, during the operation of the screw compressor (1), pre-compressed low-temperature refrigerant or compressed high-temperature refrigerant flows in the screw compressor (1). This makes temperatures in portions of the single screw compressor (1) different from each other, thereby making thermal deformation amount in such portions different from each other. Thus, a room temperature state in which, when the screw compressor (1) is stopped, the temperatures in the portions thereof are approximately the same differs from an operating temperature state in which, when the screw compressor (1) is operated, the temperatures in the portions thereof are different from each other, in shapes of the screw rotor (40) and gate rotors (50) themselves, and in a relative position between the screw rotor (40) and the gate rotor (50). In certain instances, the tip end surface of the gate (51) is firmly pushed against the bottom wall surface (44) of the spiral groove (41) of the screw rotor (40), resulting in an increase in frictional resistance therebetween in such a state.

On the other hand, as illustrated in FIGS. 13, in the present modified example, a distance $D_1$ from the central rotation axis O of the gate rotor (50) to the bottom wall surface (44) in the discharge-side portion (46) is longer than a distance $D_2$ from the central rotation axis O of the gate rotor (50) to the tip end surface of the gate (51), thereby not making the tip end surface of the gate (51) contact the screw rotor (40) along the entire length of the spiral groove (41) in the room temperature state (see FIG. 13(A)), and making the tip end surface of the gate (51) contact the screw rotor (40) along the entire length of the spiral groove (41) in the operating temperature state (see FIG. 13(B)). FIG. 13 is the screw compressor (1) of Modified Example 3 to which the present modified example is applied.

Consequently, according to the present modified example, the frictional resistance between the screw rotor (40) and the gate rotor (50) can be reduced even if the "shapes of the screw rotor (40) and gate rotors (50) themselves" or the "relative position between the screw rotor (40) and the gate rotor (50)" is changed from the room temperature state to the operating temperature state during the operation of the screw compressor (1), resulting in the narrowed space between the bottom wall surface (44) of the spiral groove (41) of the screw rotor (40) and the tip end surface of the gate (51).

Meanwhile, there are screw compressors, each of which includes a single screw rotor and a single gate rotor. In screw compressors of this type, even if a bottom wall surface of a spiral groove contacts a tip end surface of a gate in the operating temperature state, the screw rotor can slightly move to a direction perpendicular to a central rotation axis thereof, thereby not significantly increasing frictional resistance between the screw rotor and the gate rotor.

However, in the screw compressor (1) of the above-described embodiment, two gate rotors (50) are arranged so as to be axisymmetrical about the rotation axis of the screw rotor (40). That is, in the screw compressor (1), the gate rotors (50) are arranged on both sides of the screw rotor (40) in the direction perpendicular to the rotation axis of the screw rotor (40). Thus, when the gate (51) is firmly pushed against the bottom wall surface (44) of the spiral groove (41) in the operating temperature state, the screw rotor (40) is held from both sides in the direction perpendicular to the central rotation axis of the screw rotor (40) by the gates (51), thereby being more likely to excessively increase the frictional resistance between the screw rotor (40) and the gate rotor (50).

On the other hand, in the screw compressor (1) of the present modified example, the distance $D_1$ from the central rotation axis O of the gate rotor (50) to the bottom wall surface (44) in the discharge-side portion (46) is longer than the distance $D_2$ from the central rotation axis O of the gate rotor (50) to the tip end surface of the gate (51) in the room temperature state. This results in lower frictional resistance between the screw rotor (40) and the gate rotor (50) even if the space between the bottom wall surface (44) of the spiral groove (41) and the gate (51) is narrowed in the operating temperature state.

Modified Example 4 of Embodiment

In the screw compressor (1) of the above-described embodiment, the shaft (58) of the rotor support (55) is arranged only on the back side of the gate rotor (50), and the ball bearings (92, 93) for supporting the shaft (58) are also arranged only on the back side of the gate rotor (50). On the other hand, the shaft (58) of the rotor support (55) may be arranged so as to penetrate through the gate rotor (50), and each of the ball bearings (or roller bearings) for supporting the shaft (58) may be arranged on the front and back sides of the gate rotor (50).

The above-described embodiments are provided as preferable examples, and is not intended to limit the present invention, objects to which the present invention is applied, or use thereof.

Industrial Applicability

As described above, the present invention is useful in a single screw compressor.

The invention claimed is:

1. A single screw compressor comprising:

a screw rotor (40) formed with spiral grooves (41) in an outer circumference;

a casing (10) in which the screw rotor (40) is accommodated; and gate rotors (50) with a plurality of radially-formed gates (51) to be engaged with the spiral grooves (41) of the screw rotor (40), wherein the single screw compressor compresses fluid in a compression chamber (23) defined by the screw rotor (40), the casing (10), and the gate (51), by relatively moving the gate (51) from a start point to a terminal point in the spiral groove (41); and a discharge-side portion (46) is a portion of the spiral groove (41) from a predetermined position in a compression stroke to the terminal point, and a clearance between a wall surface in a suction-side portion (45) which is a portion of the spiral groove (41) other than the discharge-side portion (46), and the gate (51) is wider than that between a wall surface in the discharge-side portion (46) and the gate (51).

2. A single screw compressor comprising:

a screw rotor (40) formed with spiral grooves (41) in an outer circumference;

a casing (10) in which the screw rotor (40) is accommodated; and gate rotors (50) with a plurality of radially-formed gates (51) to be engaged with the spiral grooves (41) of the screw rotor (40), wherein the single screw compressor compresses fluid in a compression chamber (23) defined by the screw rotor (40), the casing (10), and the gate (51), by relatively moving the gate (51) from a start point to a terminal point in the spiral groove (41);

a wall surface in a discharge-side portion (46) which is a portion of the spiral groove (41) from a predetermined position in a compression stroke to the terminal point contacts both side surfaces and tip end surface of the gate (51); and a clearance between a wall surface in a suction-side portion (45) which is a portion of the spiral groove (41) other than discharge-side portion (46), and the gate (51) is wider than that between the wall surface in the discharge-side portion (46) and the gate (51).

3. The single screw compressor of claim 1 or 2, wherein the clearance between the wall surface in the suction-side portion (45) of the spiral groove (41) and the gate (51) is gradually narrowed as the gate (51) moves toward the terminal point of the spiral groove (41).

4. The single screw compressor of claim 1 or 2, wherein a clearance between a side wall surface (42, 43) in the suction-side portion (45) of the spiral groove (41) and the side surface of the gate (51) is wider than that between a side wall surface (42, 43) in the discharge-side portion (46) of the spiral groove (41) and the side surface of the gate (51).

5. The single screw compressor of claim 1 or 2, wherein a clearance between a bottom wall surface (44) in the suction-side portion (45) of the spiral groove (41) and a tip end surface of the gate (51) is wider than that between a bottom wall surface (44) in the discharge-side portion (46) of the spiral groove (41) and the tip end surface of the gate (51).

6. The single screw compressor of claim 4, wherein, in the screw rotor (40), only the side wall surface (42) of a pair of the side wall surfaces of the spiral groove (41), which is positioned on a front side in a traveling direction of the gate (51) is partially removed so that the clearance between the side wall surface (42, 43) in the suction-side portion (45) and the gate (51) is wider than that between the side wall surface (42, 43) in the discharge-side portion (46) and the gate (51).

7. The single screw compressor of claim 1 or 2, wherein a distance from a central rotation axis of the gate rotor (50) to the bottom wall surface (44) in the discharge-side portion (46) is made longer than that from the central rotation axis of the gate rotor (50) to the tip end surface of the gate (51) so that the tip end surface of the gate (51) contacts the bottom wall surface (44) in the discharge-side portion (46) only during an operation of the single screw compressor.

8. The single screw compressor of claim 1 or 2, wherein the plurality of gate rotors (50) are arranged at equal angular interval about a central rotation axis of the screw rotor (40).

* * * * *